United States Patent [19]

Moore

[11] 3,985,359

[45] Oct. 12, 1976

[54] PORTABLE SPORTS COURT BOUNDARY

[76] Inventor: David W. Moore, 3228 Atlanta St., Fairfax, Va. 22030

[22] Filed: May 9, 1975

[21] Appl. No.: 575,993

[52] U.S. Cl. ..... 273/95 H; 242/118.41

[51] Int. Cl.[2] ..... A63B 71/02

[58] Field of Search ..... 273/95 H, 1 A, 95 R, 273/102 R; 242/85, 96, 118.41

[56] References Cited

UNITED STATES PATENTS

| | | | |
|---|---|---|---|
| 638,220 | 12/1899 | Wolf | 273/95 H |
| 1,448,505 | 3/1923 | Powers | 242/96 |
| 2,207,864 | 7/1940 | Hoeltje | 273/95 H |
| 2,283,710 | 5/1942 | Waterbury | 242/118.41 |
| 3,110,498 | 11/1963 | Sheldon | 273/1 A |
| 3,179,351 | 4/1965 | Ehlert | 242/96 |
| 3,345,068 | 10/1967 | Bowen | 273/1 A |
| 3,409,255 | 11/1968 | Sada | 242/96 |
| 3,434,590 | 3/1969 | Laughlin | 242/118.41 |

*Primary Examiner*—Richard C. Pinkham
*Assistant Examiner*—Marvin Siskind
*Attorney, Agent, or Firm*—Berman, Aisenberg & Platt

[57] ABSTRACT

A portable court boundary for a sport such as badminton or volleyball is formed of flexible cord or twine. The boundary is designed to be wound upon a specially constructed spool so that it can be easily unrolled and laid in place on the surface where it is desired to play the game. The spool has a hollow interior within which are stored hooks for anchoring the boundary to the playing surface. To assist in properly disposing the boundary, each of the boundary corners is color coded with a different color.

7 Claims, 7 Drawing Figures

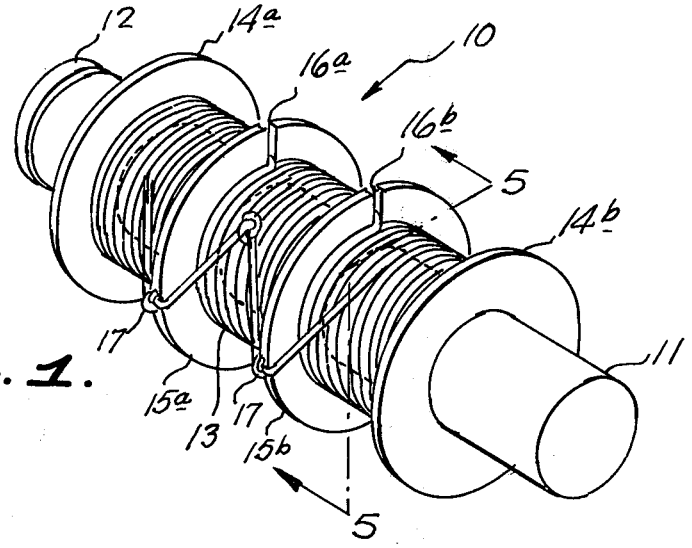
FIG. 1.
FIG. 2.
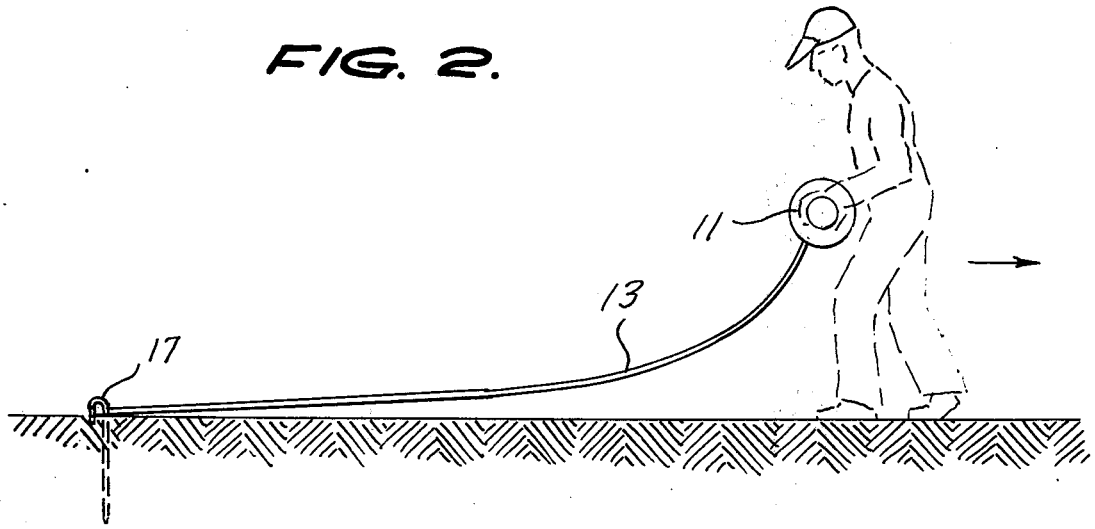
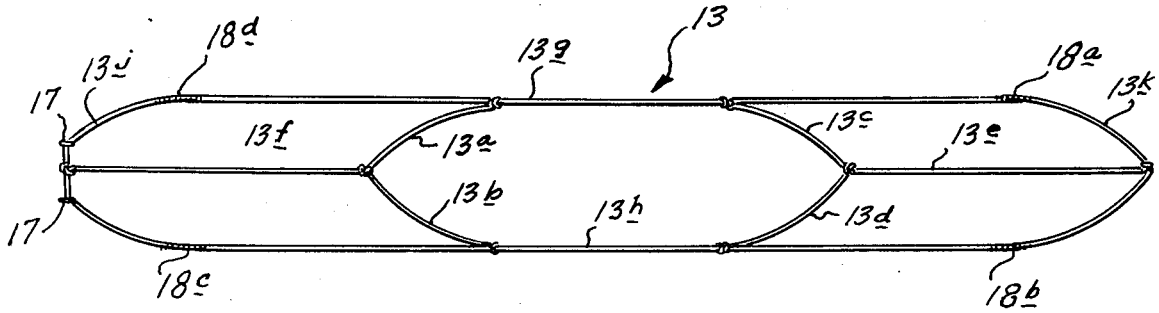
FIG. 3.

PORTABLE SPORTS COURT BOUNDARY

BACKGROUND OF THE INVENTION

1. Field of the Invention

This invention relates generally to sports such as badminton or volleyball, played on a court. More particularly, this invention relates to a portable boundary or court marking for such sports.

2. The Prior Art

Heretofore, whenever it was desired to play a game such as badminton on a lawn or at a picnic site, for example, it has been necessary to painstakingly measure the required distances from the net to the various boundaries and then mark the boundaries by means of tape or other suitable marking material. More usually, no boundaries whatever were set up, except in a very approximate sense, and in such cases the resulting game was far from satisfactory.

OBJECTS AND SUMMARY OF INVENTION

Accordingly, it is a principal object of the present invention to provide a portable court boundary outline to be used with games such as badminton or volleyball which can be conveniently and readily installed on a playing surface not susceptible to permanent court markings.

Another object of the present invention is to provide a court boundary outline for sports such as badminton which is permanently assembled and measured to the proper dimensions.

A further object of the present invention is to provide a portable court boundary outline for sports such as badminton which can be conveniently stored on a spool and unrolled when desired.

Still another object of the present invention is to provide a storage spool for a portable court boundary for sports such as badminton which also serves as a storage container for anchor devices for securely fastening the court boundary to the desired playing surface.

These and other objects of the present invention are achieved by constructing the court boundary in the proper dimensions of twine or some other thin flexible material and then winding the boundary upon a specially designed spool having four extending discs thereon. The two outer discs are solid while the two inner discs are provided with slots to permit the various lines comprising the boundary to cross over from one portion of the spool to another so that the boundary will lie flat on the spool after it is entirely rolled thereon. The interior of the spool is hollow and is designed to store hooks for anchoring the boundary in place. When it is desired to set up the boundary in a selected playing area, the boundary is slowly unrolled from the spool and the various corners thereof, which are color-coded in order to assist in the set-up procedure, are anchored in place until the entire boundary is unrolled and secured.

BRIEF DESCRIPTION OF THE DRAWINGS

FIG. 1 is a perspective view of the portable court boundary assembled on the spool.

FIG. 2 is a schematic view illustrating the method of unrolling the boundary from the spool.

FIG. 3 is a plan view of the portable sports court boundary of the present invention in an initial stage of being deployed for use.

DETAILED DESCRIPTION OF THE INVENTION

Figure 4:
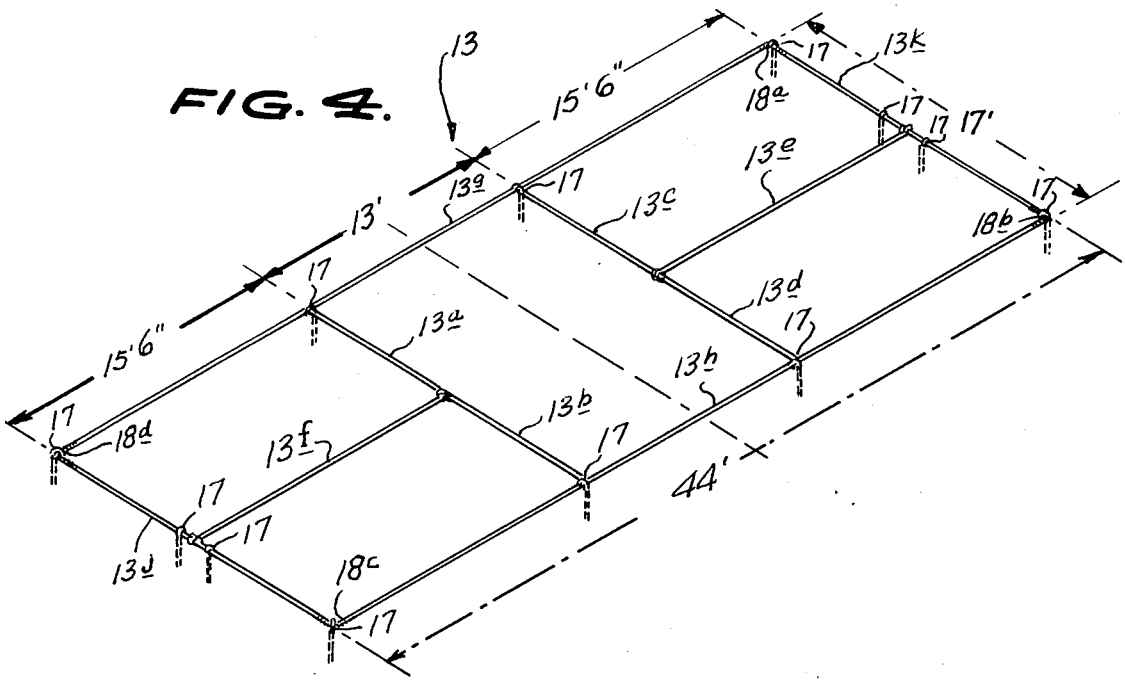
FIG. 4 is a perspective view of the portable sports court boundary of the present invention after it has been anchored in place for use.

Referring now to the drawings, and more particularly to FIG. 3, it can be seen that the portable sports court boundary 13 of the present invention, shown for purposes of illustration as applied to the sport of badminton, consists of a series of interconnected sections of twine or other flexible material. As shown in FIG. 3, sections 13*a* and 13*b* together form one short service line, while sections 13*c* and 13*d* form the other short service line. Sections 13*j* and 13*k* form the back boundary lines and sections 13*e* and 13*f* form the center lines for dividing the court into left-half and right-half courts. Sections 13*g* and 13*h* form the side lines. FIG. 4 shows the portable sports court boundary of the present invention as it is used to play the game of badminton, with the official badminton single court dimensions indicated thereon. The portable sports court boundary 13 is provided with color-coded corners 18*a*, 18*b*, 18*c* and 18*d*, which may for example be respectively red, blue, pink and yellow. The purpose of color coding the corners will become more apparent from the description set forth hereinbelow of the manner in which the portable sports court boundary is laid out for use in the game of badminton, for example.

Figure 5:
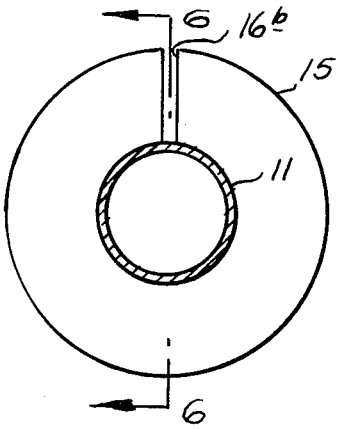
FIG. 5 is a sectional view taken on line 5—5 in FIG. 1.
Figure 6:
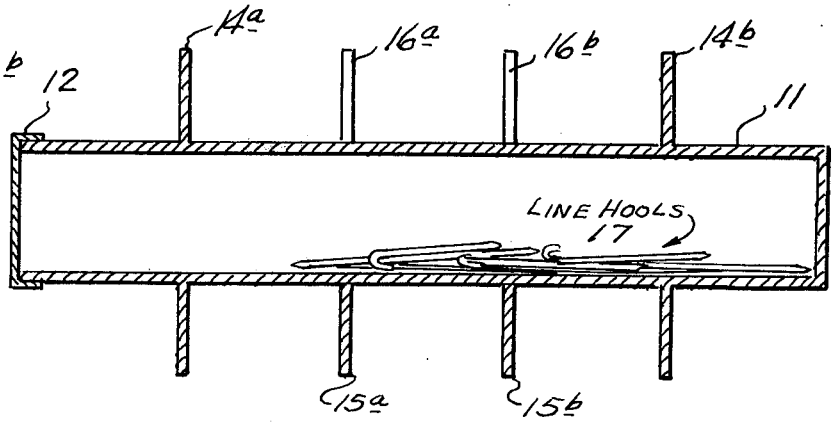
FIG. 6 is a sectional view taken on line 6—6 in FIG. 5.

Referring now to FIGS. 1, 5 and 6, it can be seen that the entire assembly of the portable sports court boundary and its storage device, generally designated by the reference numeral 10, comprises a hollow spool 11 of generally cylindrical shape, capped at its open end by cap 12 which may be formed of plastic or any other suitable material. Disposed on the outer periphery of spool 11 are outer discs 14*a* and 14*b* and inner discs 15*a* and 15*b* which divide the spool into three sections for storing the portable sports court boundary 13. Slots 16*a* and 16*b* are provided in discs 15*a* and 15*b*, respectively, to permit the connected sections 13*a*, 13*b*, 13*c* and 13*d* of the portable sports court boundary 13 to cross over from one storage portion of spool 11 to another in order to cause the sections to lie flat on the spool and store uniformly. It will be noted that, referring back to FIG. 3, the end portions of the portable sports court boundary 13 comprise three parallel lines which can be wound separately on the three sections of spool 11 defined by discs 14*a*, 14*b*, 15*a* and 15*b*. However, sections 13*a*, 13*b*, 13*c* and 13*d* create a situation where four sections of line must be stored. Therefore, slots 16*a* and 16*b* are necessary to permit these sections of the portable sports court boundary to lie flat on the spool and store uniformly among the three storage portions of spool 11.

Figure 7:
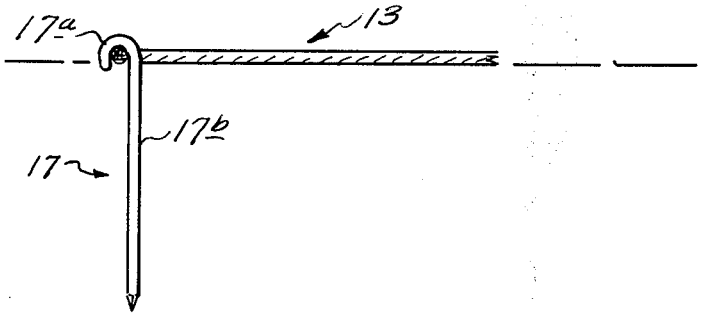
FIG. 7 is an elevational view showing the manner in which the portable sports court boundary of the present invention is anchored in place.

Referring particularly to FIG. 6, it will be seen that line hooks 17 which are formed of metal or any other suitably rigid material are stored within the hollow interior of spool 11 and are readily accessible for use by simply removing cap 12. As shown in FIG. 1, two of the line hooks 17 are utilized to hold the portable sports court boundary in place on spool 11 and prevent it from inadvertently unwinding. For this purpose, the center discs 15*a* and 15*b* are preferably formed of a corrugated material or the like, which is readily susceptible to the insertion and removal of line hooks 17. As shown in more detail in FIG. 7, line hook 17 comprises a curved portion 17*a* which engages over a line of the portable sports court boundary 13 and a straight spiked portion 17*b* which is adapted to be anchored into the ground as seen for example in FIG. 2.

In settig up the portable sports court boundary of the present invention, the two line hooks 17 are removed from the center discs 15*a* and 15*b* and the initial portion of the sports court boundary in unrolled and anchored in place by the two line hooks 17 in a suitable playing area, as shown in FIGS. 2 and 3. The spool is then lightly held in order to permit it to rotate and the individual setting up the boundary will back away from the starting point as shown in FIG. 2 permitting the entire sports court boundary to unroll from spool 11. As the boundary unrolls, color-coded corners 18*a*, 18*b*, 18*c* and 18*d* will appear. After the entire sports court boundary has been unrolled and is lying flat on the ground, cap 12 will be removed and additional line hooks 17 taken from the hollow interior of spool 11. These additional line hooks will then be utilized to anchor corners 18*a*, 18*b*, 18*c* and 18*d* (easily identified due to their color coding) in place and additional line hooks will be deployed as needed to square up the sports court boundary, as shown in FIG. 4.

In order to roll up the portable sports court boundary 13, all line hooks 17 are removed except for the two initially installed as shown in FIG. 3. The portable sports court boundary 13 is then stretched to the position shown in FIG. 3 and holding the spool 11 in one hand, the three lines comprised of the sections 13*k*, 13*g* and 13*h* are placed into the two slotted center discs 15*a* and 15*b* of spool 11. The sports court boundary outline 13 is then rolled up by proceeding in the direction opposite to that shown in FIG. 2. As explained above, when the sport court boundary outline becmes four lines, as for example when line sections 13*c* and 13*d* are encountered in the rolling up process, the lines are fed across slots 16*a* and 16*b* in order to evenly distribute the lines among the three sections of spool 11 and to permit the boundry outline to lie flat on the spool. After the sports court boundary has been fully rolled up, line hooks 17 shown in FIG. 3 are removed from the ground are inserted in center discs 15*a* and 15*b* as shown in FIG. 1. All the other line hooks are then stored again in the interior of cylinder 11 as shown in FIG. 6.

While a specific embodiment of the invention has been illustrated, it will be understand that various changes may be made therein without departing from the true spirit and scope of the invention. For example, the invention is readily adapted to sports other than badminton, including lawn volleyball and the like. Therefore, it is intended that the scope of the invention be defined only by the claims appended below.

I claim:

1. A boundary for a sport such as badminton played on land within an enclosed defined area, comprising a continuous enclosed outer boundary of a shape conforming to said enclosed defined area and a plurality of line segments connected to said outer boundary interiorly thereof and forming sub-boundaries within said outer boundary, said line segments being formed of a flexible material and said unitary boundary as a whole being capable of integral placement in a desired location for playing said sport and integral removal from said location, and anchor means for securing said boundary in said desired location, and wherein said boundary is of sufficient flexibility to permit it to be wound on a spool, and spool means on which said boundary is wound.

2. The combination set forth in claim 1 wherein said spool has hollow interior means for storing said anchor means, said anchor means being disposed within said hollow interior means.

3. The combination set forth in claim 1 wherein said spool is provided with means for dividing its surface into a plurality of sections.

4. The combination set forth in claim 3 wherein said means for dividing comprises a plurality of discs.

5. The combination set forth in claim 4 wherein said boundary comprises a plurality of line segments and said means for dividing includes means for enabling certain of said line segments to be wound on at least two sections.

6. The combination set forth in claim 5 wherein said means for enabling comprises slot means in at least one of said discs.

7. The combination set forth in claim 1 wherein said outer boundary is substantially rectangular in shape and has a plurality of corners at least one of said corners being marked with identifying indicia, to permit said boundary to be accurately placed when it is unwound from said spool.

* * * * *